US005099586A

United States Patent [19]

Anderson

[11] Patent Number: 5,099,586

[45] Date of Patent: Mar. 31, 1992

[54] REFLECTOR ASSEMBLY FOR HEATING A SUBSTRATE

[75] Inventor: Kim A. Anderson, Green Bay, Wis.

[73] Assignee: W. R. Grace & Co.-Conn., New York, N.Y.

[21] Appl. No.: 404,928

[22] Filed: Sep. 8, 1989

[51] Int. Cl.[5] ..... F26B 19/00

[52] U.S. Cl. ..... 34/68; 34/1 W; 34/18

[58] Field of Search ..... 34/4, 41, 39, 68, 60, 34/18, 1 W; 392/422, 433; 250/494.1, 503.1, 504 R, 495.1

[56] References Cited

U.S. PATENT DOCUMENTS

| | | | |
|---|---|---|---|
| 3,733,461 | 5/1973 | Rohats | 392/423 |
| 4,015,340 | 4/1977 | Treleven | 34/4 |
| 4,434,562 | 3/1984 | Bubley et al. | 34/4 |
| 4,506,454 | 3/1985 | Kerschgens | 34/4 |
| 4,693,013 | 9/1987 | Pabst et al. | 34/4 |
| 4,727,655 | 3/1988 | Jacobi, Jr. | 34/41 X |

*Primary Examiner*—Henry A. Bennett

*Attorney, Agent, or Firm*—Kevin S. Lemack; William L. Baker

[57] ABSTRACT

A reflector for use in drying a substrate is disclosed, which houses infrared or ultraviolet lamps. The reflector is designed to limit the path of light from each lamp to mitigate interference from one lamp to the next. The reflector is cooled and the substrate is heated by convection.

13 Claims, 6 Drawing Sheets

REFLECTOR ASSEMBLY FOR HEATING A SUBSTRATE

BACKGROUND OF THE INVENTION

1. Field of the Invention

The present invention relates to infrared and ultraviolet reflectors for use in drying, such as drying moisture or ink on a substrate, such as a traveling web of material.

2. Description of the Prior Art

The use of infra red radiation to dry webs is known. U.S. Pat. No. 4,693,013 to Pabst et al. discloses an infra red dryer for drying fabric webs. The radiators can be pivoted into a "waiting position" to direct the emitted radiation away from the web so that they can remain fully energized without burning the web once the web is dried, or without burning the web if it stops moving.

U.S. Pat. No. 4,015,340 to Treleven discloses ultraviolet radiating assemblies. Ultraviolet mercury quartz lamps are received within an elongated reflector having a generally elliptically shaped inside surface cross-section to focus the emitted light. The reflector includes a plurality of cooling fins. The reflector and lamps are supported by a reflector carrier, which is then slidably mounted in a lamp module. The module includes flat rectangular metal frame heat exchangers to assist in removing heat from the modules. The modules are encased in a housing having an exhaust chamber attached to a fan to pull air through the housing which also cools the components therein.

Typical prior art reflectors have poor resolution, in that they do not block the light between adjacent lamps. Thus too large of a dissipation pattern of light results. Light from one lamp can affect areas 4 or 5 zones away. Controlling the drying of specific areas of the web by independently controlling individual lamps is extremely difficult where such a large dissipation pattern is present. The shape of the reflector is also important in avoiding reflector material degradation, including melting of the reflector.

SUMMARY OF THE INVENTION

The problems of the prior art have been overcome by the present invention which provides a heating unit having infrared, ultraviolet or the like radiating means for heating, drying and/or curing a coated substrate such as a web. The substrate may be comprised, for example, of material such as paper, fabric or thin metal sheets in continuous lengths. The heating unit is built from modules or casings allowing for ease in changeability and maintenance of the radiating lamp and reflector. The reflector has a configuration such that it reflects most of the radiant light out towards the substrate, and such that convection is optimized to cool the assembly. The resulting heated convection air enhances drying efficiency by flowing out of the reflector and impinging on the web. Each reflector structure prevents lamps in adjacent reflectors from interfering with lamps in other reflectors and enables the drying of specific regions of a web. To this end, each radiating unit can be controlled individually and turned on or off depending on the sensed moisture content of a particular portion of the web. Heating units can be used in conjunction with conventional web dryers and can be placed before or after the dryer. The radiating structure can be positioned on either or both sides of the web. The reflector design also protects the substrate from contacting the lamp itself should the traveling web be stopped or should a malfunction occur. The heating unit is self-contained air cooled.

More specifically, the apparatus of the present invention includes at least one lamp supported in a reflector which focuses the emitted light to a narrow range and through which a gas such as air can be passed to create convection currents which aid in drying a coated web and which help cool the assembly. The apparatus is especially applicable to supplement existing drying systems where coatings can be catalyzed by infrared or ultraviolet light in lieu of heat.

Significant aspects and features of the present invention include a heating unit that is module and expandable as required. A unique infrared lamp reflector provides high resolution of infrared lighting. The heating units can be placed in series, before or after a dryer, or any combination, depending on the application. The heating units can be used on both sides of the web, or only on one side. A single heating unit with lamps on both sides of the web can have 200 watts/inch. The heating unit has a self-contained cooling system. Unlike other systems, the reflector design confines the light to a specific path, which prevents light from one reflector assembly from affecting the web 4 or 5 zones away. The reflector provides web support on shut down via air distribution and prevents mechanical interference. The combined reflector cooling and impingement air contribute to increased efficiency.

It is therefore an object of the invention to provide a heating unit having reflector means for controlling the width of a light beam.

It is a further object of the invention to provide a heating unit reflector means that is cooled by convection.

Still another object of the invention is to provide a heating unit that utilizes convection together with IR or UV light to dry a substrate.

A still further object of the invention is to provide a heating unit having reflector means that houses a lamp and protects the substrate from contacting the lamp.

These and other objects of the invention will become apparent upon reference to the accompanying specification and drawings.

DETAILED DESCRIPTION OF THE PREFERRED EMBODIMENTS

Figure 1:
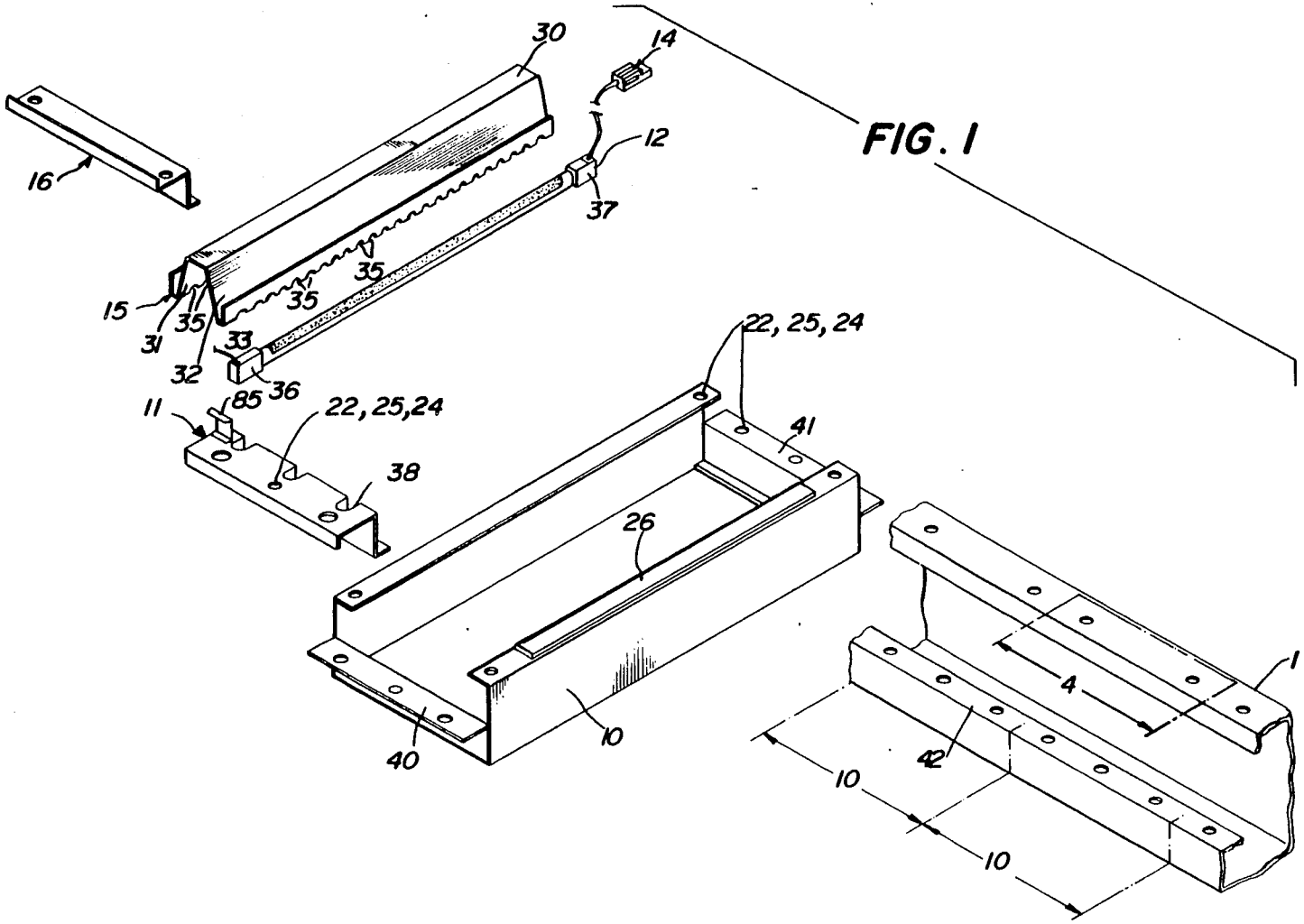
FIG. 1 is an exploded view of a reflector and reflector casing in accordance with the present invention.

Turning now to FIG. 1, one embodiment of reflector 15 is illustrated. The reflector 15 material is preferably anodic clad aluminum in which dimples have been made to provide structural strength and aid in the diffusion of light. A suitable material is sold under the name Rigid-Tex® by Rigidized® Metals Corporation. The reflector means 15 comprises a top substantially planar reflector portion 30 having opposed reflector side walls 31, 32 that are increasingly angled away from each other as they extend downwardly from top portion 30. The particular angle will of course depend on the application, and specifically, the desired light dissipation pattern. Although a parabolic shape is functional, a preferred angle is about 15° per side relative to vertical. As the angle approaches 0°, the desired light path is lost. As the angle approaches 90°, melting of the reflector tends to occur. Each reflector side wall 31 and 32 is bent to form channel bottoms 33, 34 by, for example, known breakpress forming techniques. Preferably the channel bottoms 33, 34 are substantially U-shaped, and have rounded edges. Square edges, although functional, tend to create deleterious stress points in the reflector material. A plurality of holes 35 are formed in the reflector, as by drilling, so that the majority of their area occurs in the low point of said channel bottoms. Holes having a diameter of about ¼" before the side walls are bent are suitable. If the diameter is too large, strength between holes is sacrificed. Too small a diameter results in lost convection.

The reflector 15 houses lamp 12. Lamp 12 is preferably positioned inside reflector 15 near top portion 30. Lamp 12 emits light of the appropriate wavelength, such as IR or UV, depending on the intended application. A suitable IR lamp includes a 12" long, 2000 watt, 250 volt bulb. The flexibility of the reflector design is manifested in its ability to accommodate more than one lamp, and alternative lamps and lamp styles. The ends 36, 37 of lamp 12 sit in aperture 38 of lamp holder 11 (only one shown) which is secured to reflector casing 10 by suitable means; such as a cap screw and lockwasher (not shown). Lamp holder 11 should comprise a material suitable to inhibit the dissipation of light at vertical ends of the lamp, provide supporting strength, have good temperature resistance and be thin enough to dissipate heat. The 300 series (ASTM) stainless steel has been found to be suitable, preferably that having a thickness in the range of about 0.018–0.05", most preferably about 0.036". The particular design of lamp holder 11 and aperature 38 will depend on the specific lamp style used. In the design shown, a bent sheet metal member 85 is attached to lamp holder 11 to help block light emitted from lamp 12. In the embodiment shown in FIG. 1, a series of three lamps 12 and reflector 15 is housed in casing 10. The casing 10 can of course be designed to house any number of lamps 12, depending on the intended application. This flexibility makes almost any size heating unit possible.

A reflector and lamp retainer 16 is secured to casing 10, and specifically, to lamp holder 11, such as by fastening means connected through the illustrated holes. The casing 10 is mounted in side mainframe 1 by securing flanges 40, 41 of casing 10 to lip 42 of the mainframe 1. Mainframe 1 can hold a plurality of casings in side-by-side relation.

Figure 2:
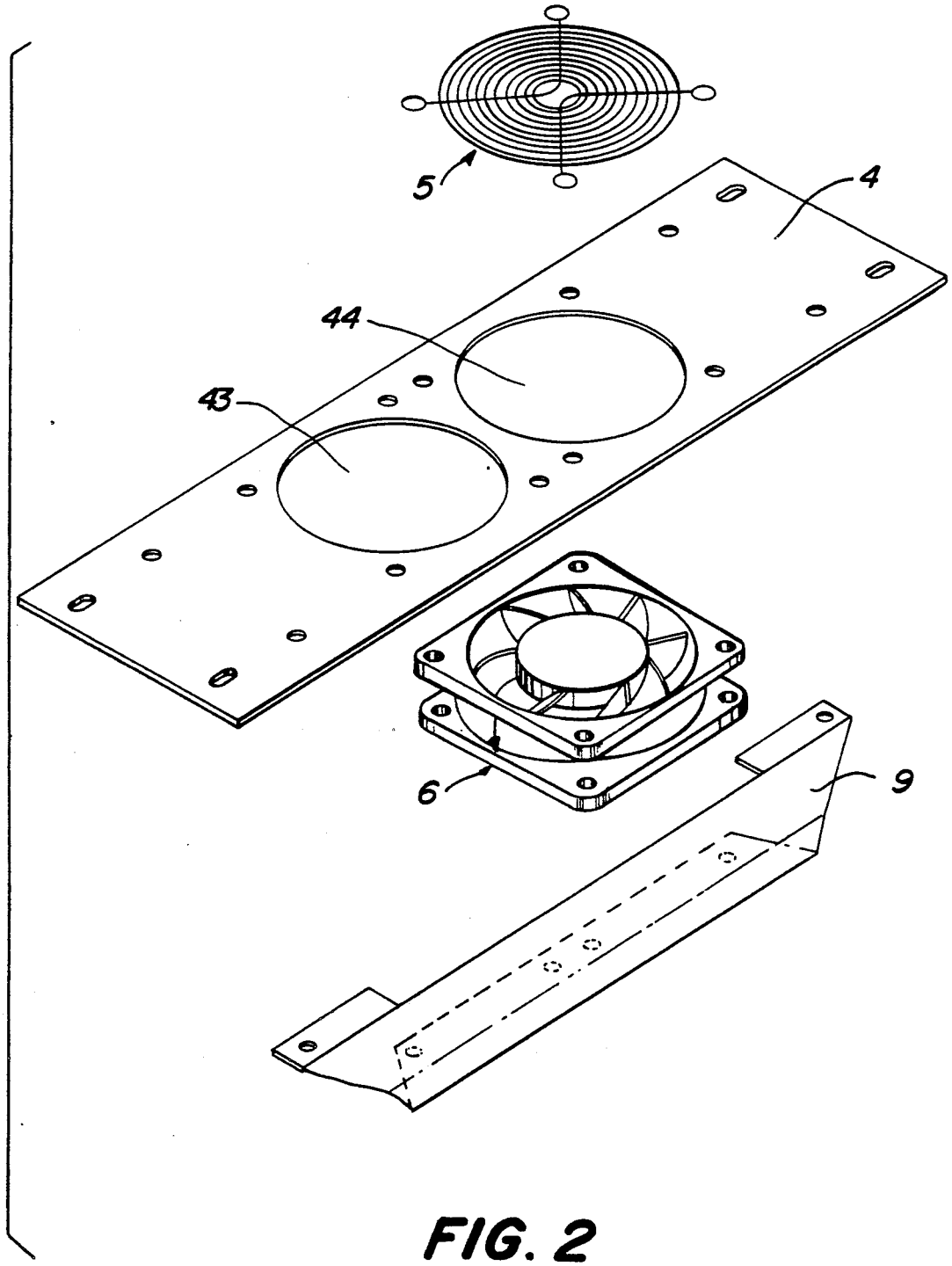
FIG. 2 is an exploded view of a fan assembly for use with the modules of the instant invention.

FIG. 2 illustrates the convection means that is mounted on the top of casing 10. During operation, the center of lamp 12 is typically the hottest. Convection currents through reflector 15 are optimized for cooling the assembly and for heating or drying the substrate where two fans are mounted near the center, in the longitudinal direction, of reflector 15, so that the largest volume of gas is moved at the hottest point. To this end, fan plate 4 has two central apertures 43, 44 in which fan 6 and fan guard 5 are mounted. A fan plate brace 9 is secured to fan plate 4 and fan 6 as shown. The fan assembly is mounted on casing 10 and on side mainframe 1 as shown in FIG. 1. A gasket 26 such as a silicone gasket, may be placed between casing 10 and fan plate 4 to help seal the unit.

Figure 3:
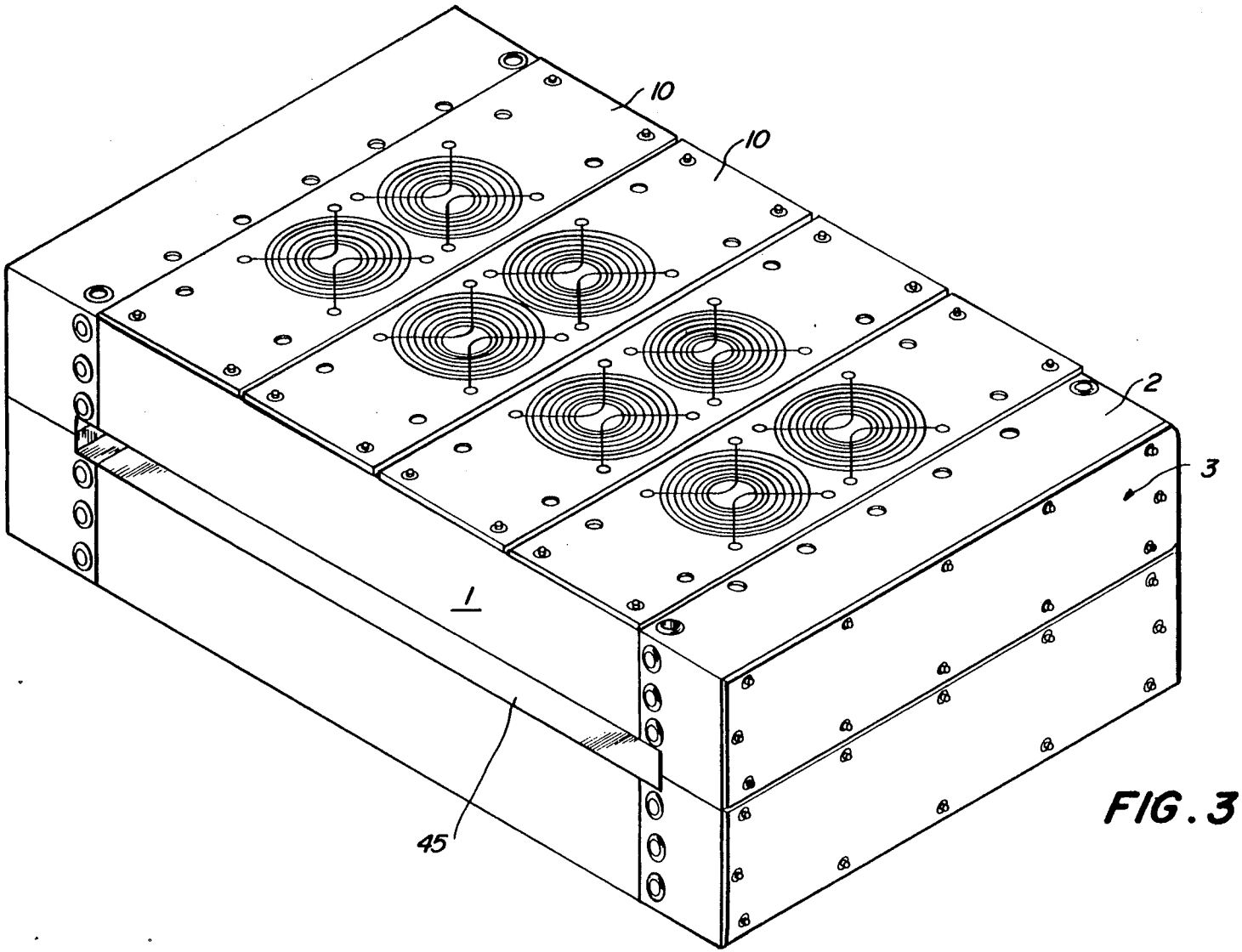
FIG. 3 is an isometric view of adjacent modules positioned above and below a web path.

FIG. 3 shows a complete heating unit having four casings 10 aligned above and below a web slot 45. The casings 10 are aligned so that the lamps 12 and reflectors 15 are positioned in the longitudinal direction of the moving web. Mainframe end covers 2, 3 together with mainframe sides 1 secure the casings 10 to form the heating unit.

Figure 4:
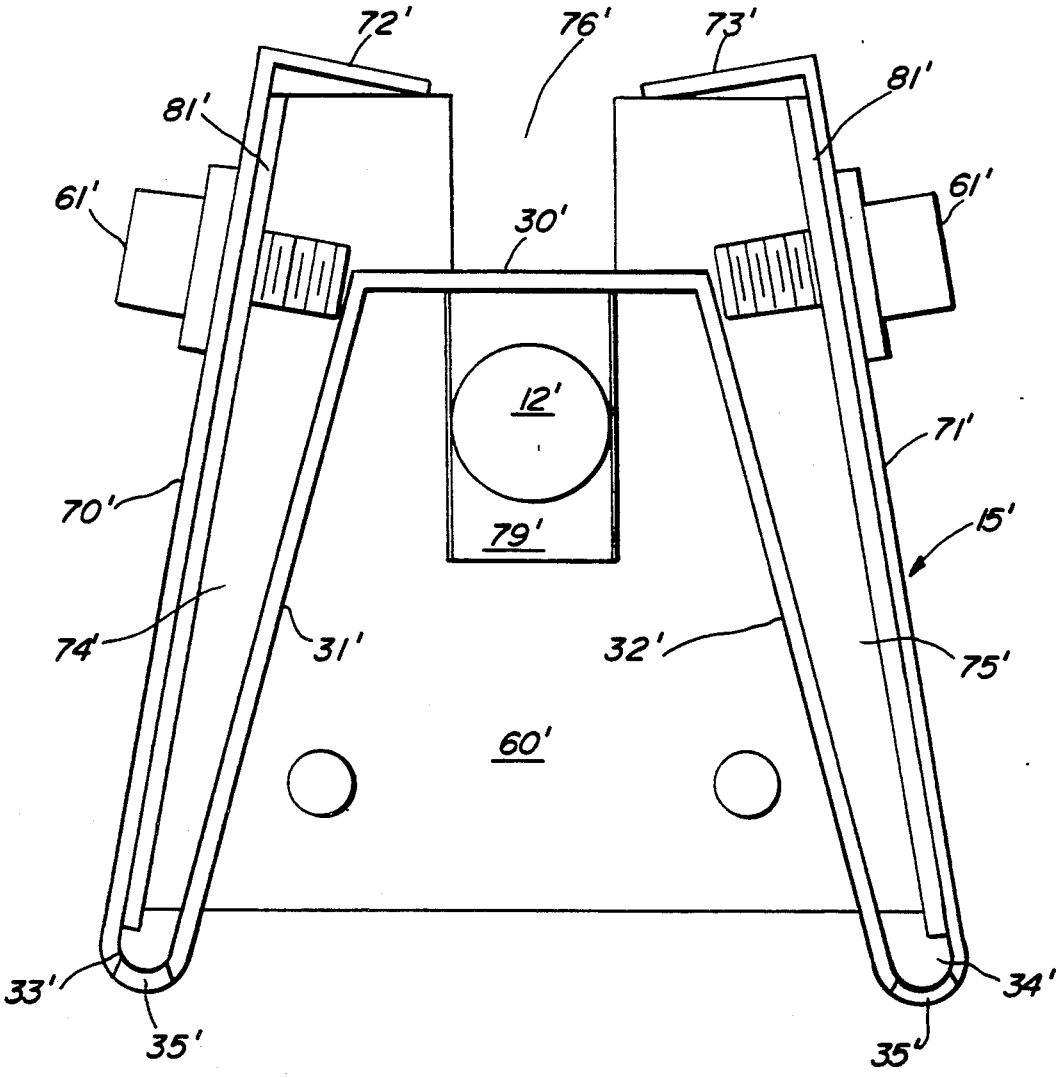
FIG. 4 is a cross-sectional view of a reflector in accordance with one embodiment of the present invention.

FIG. 4 shows a second embodiment of the reflector and lamp assembly. Reflector 15' comprises a substantially planar top reflector portion 30' having opposed inner reflector side walls 31', 32' that are increasingly angled away from each other as they extend downwardly from top reflector portion 30'. As with the first illustrated embodiment, the particular angle employed is a function of the desired light dissipation pattern. An angle of about 15° per side relative to vertical is preferred. Each side wall 31', 32' is bent to form preferably U-shaped channel bottoms 33', 34'. A plurality of holes 35' preferably having a diameter of about ¼ inch before the side walls are bent, are formed in the reflector 15' so that the majority of their area occurs at the lowest point of said channel bottoms. Each end of reflector 15' is secured to flanges 81 of end plates 60' (only one shown) by any suitable means, such as screws 61'. Unlike the embodiment of FIG. 1, inner side walls 31', 32' do not terminate just after defining channel bottoms 33', 34', but rather continue upwardly as outer walls 70' and 71', respectively. Outer walls 70', 71' terminate in top flanges 72', 73', respectively.

Outer wall 70' and flange portion 72' define with inner reflector side wall 31' and top portion 30' an elongated tapered channel 74'. Similarly, outer wall 71' and flange portion 73' define with inner reflector side wall 32' and top portion 30' an elongated tapered channel 75'. Flanges 72' and 73' define with top portion 30' an entrance way 76', through which convection in the reflector originates by a fan assembly (not shown). Entrance way 76' also conveniently serves as a receptacle for the wires used to connect lamp 12' to a power source. Tapered channels 74', 75' become increasingly narrow as holes 35' are approached, so as to increase the velocity of the convection currents forced therethrough to create improved flow and convection. This results in improved cooling of the reflector 15' and improved heating or drying of the substrate. In addition, the structure tends to be very durable.

Figure 5:
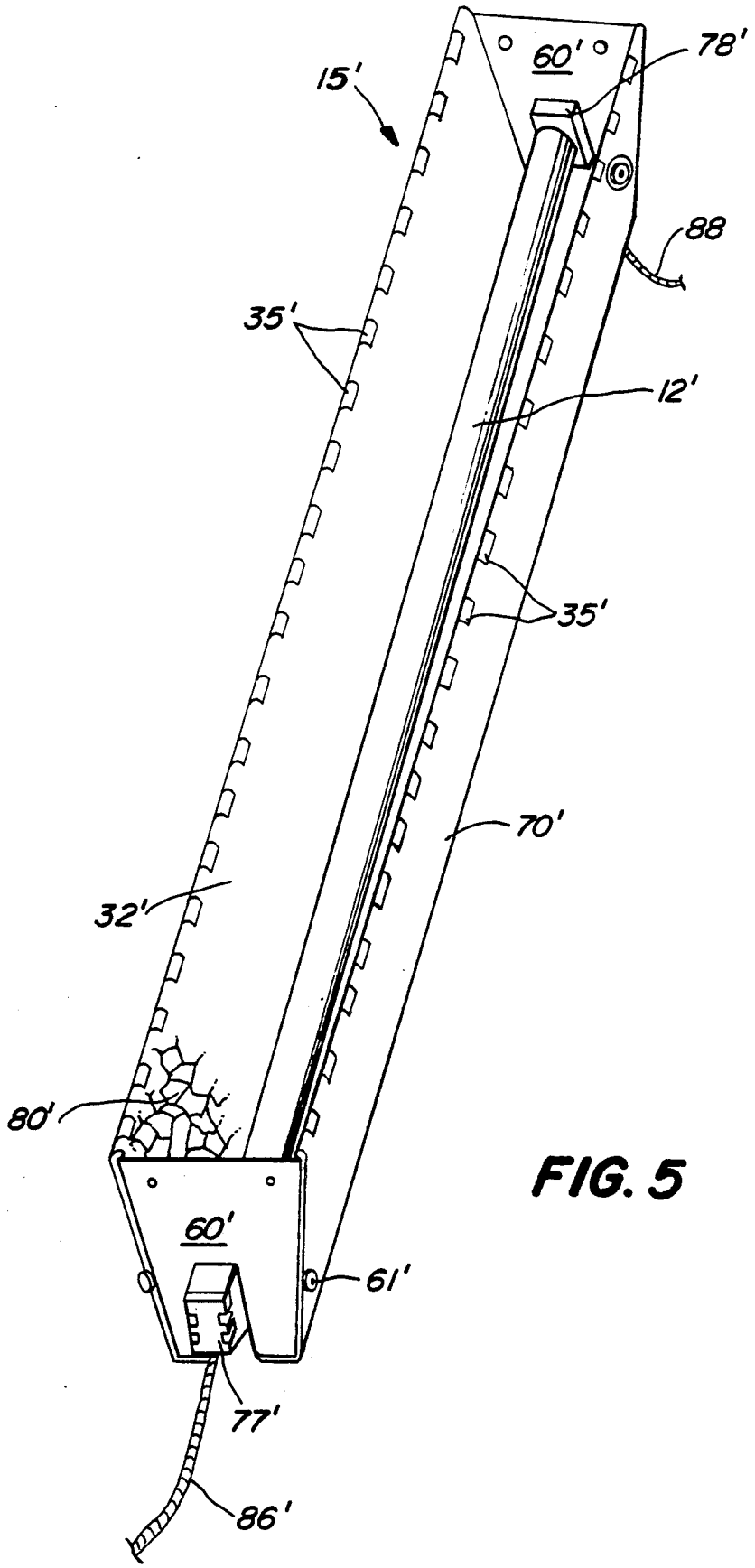
FIG. 5 is a perspective view of a reflector in accordance with one embodiment of the present invention.

As can be seen upon reference to FIGS. 4 and 5, lamp 12' is housed in reflector 15' under top reflector portion 30'. Lamp ends 77', 78' sit in cut-out 79' in each end plate 60'. Holes 35' are spaced apart from each other a distance such that there preferably are about two holes per inch of reflector. Wires 86' and 88' extend from lamp ends 77', 78' respectively. The wires are preferably teflon coated and are heat resistant to a temperature of about 450° (during continuous operation). Wires 86' and 88' are connected to power leads (not shown) of similar heat resistance by suitable means.

Figure 6:
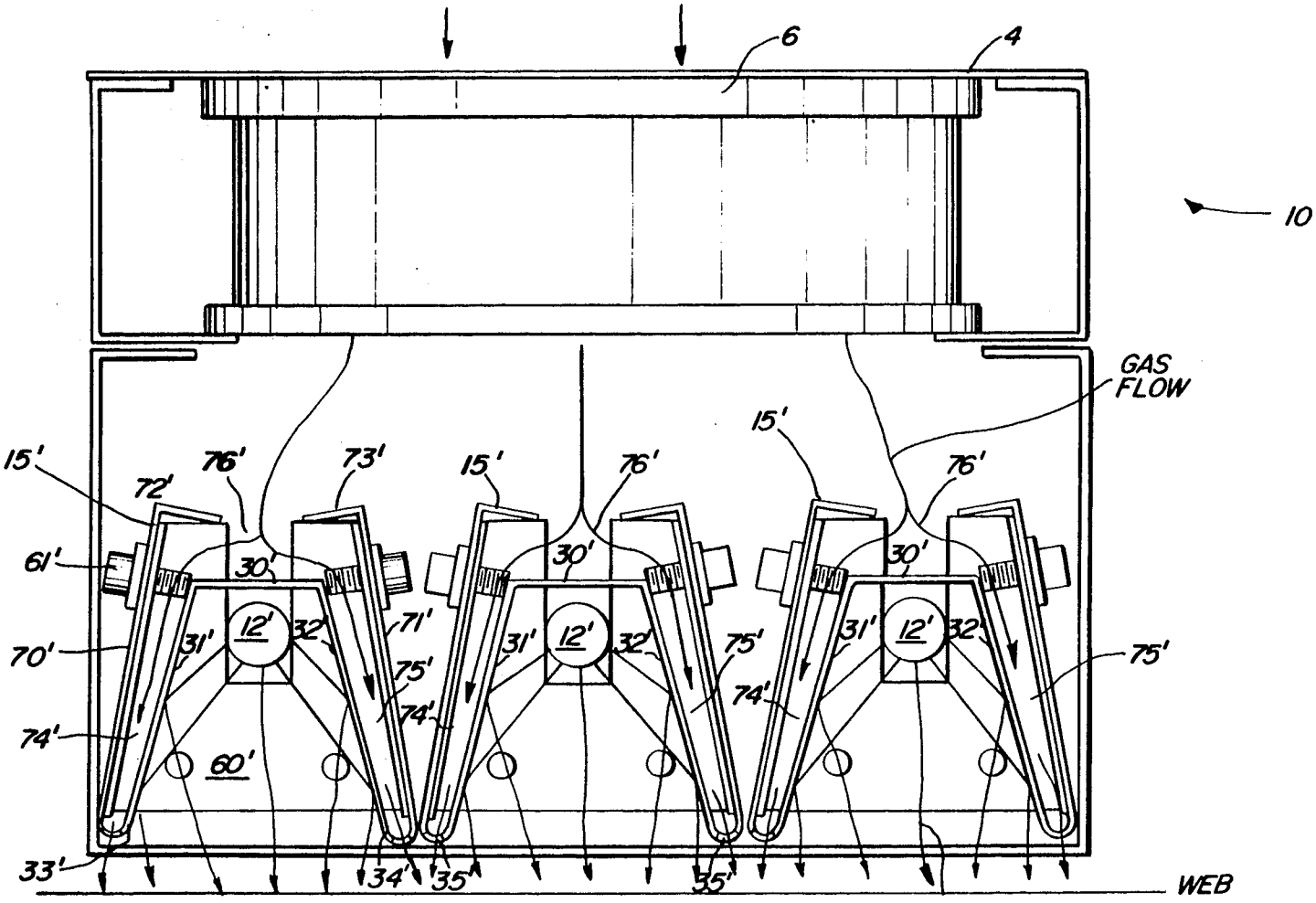
FIG. 6 is a cross-sectional end view of an assembled casing in accordance with the present invention.

FIG. 6 shows in cross-section an assembled casing 10 having three reflectors 15 in side-by-side relation. Fans 6 create the convection currents that flow substantially along the paths depicted by arrows; that is, into reflectors 15 through entrance way 76', into tapered channels 74', 75', and out through apertures 35' in the respective channel bottoms 33', 34'. The spent cooling air that flows out through apertures 35' is hot, and is used to enhance drying efficiency by impinging on the web. Similarly, infrared rays emitted from lamp 12' are shown reflecting off inner side walls 31', 32' and impinging on the web.

Regardless of the particular reflector design embodiment used, the holes 35 should have sufficient diameters to allow enough gas to pass through for both cooling the reflector and heating or drying the web. The holes 35 should be substantially hidden from the lamp so as to mitigate local deterioration of the reflector material. For a reflector housing a 12 inch lamp, about 2 holes per inch of reflector has been found to be effective. Also shown partially in FIG. 5 are dimples 80' that can be formed in the surface of reflector 15' and which may add strength thereto and improve the diffusion of light.

Operation of the radiating assembly is as follows. A lamp 12 is installed in the reflector 15 and the combination is placed in a casing 10. The procedure is repeated until the casing 10 is full, which typically is three reflectors and lamps. Two fans are positioned near the center of the lamps and secured to the casing 10 by fan plate 4. Similar casings are aligned to form a heating unit, such as that shown in FIG. 3. Current is applied to the lamps and the fans so that radiation and convection commences. Ambient air flows from the fans through the holes formed in the channel bottoms of the reflectors so as to heat or dry the substrate passing through the heating unit web slot and also cool the reflector.

A moisture and/or temperature profiling system can be positioned downstream from the unit to sense what portion of the substrate requires drying, and the lamps can be individually controlled to accommodate the requirement. Convection can be continued even when all lamps shut off, so as to maintain clearance between the substrate and the reflector surface.

What is claimed is:

1. Radiating assembly means for heating a substrate comprising:

reflector means comprising and elongated substantially planar top reflector member having elongated opposed reflector arms each extending, downwardly therefrom at an increasing angle with respect to each other, each elongated opposed reflector arm being connected to an elongated out side wall by a channel bottom, each of said channel bottoms having a plurality of holes along its length which permit the passage of convection currents through said assembly and direct the same towards said substrate for impingement thereon; and radiating means supported in said reflector means.

2. The radiating assembly means of claim 1, wherein said outer side walls extend above said top reflector member and terminate in flange portions; each of said outer side walls defining with an opposed reflector arm a channel; said flange portions defining therebetween access to said channels.

3. The radiating assembly means of claim 2, wherein said channels narrow toward said channel bottoms.

4. The radiating assembly means of claim 1, further comprising opposed end walls, and wherein said radiating means is supported by said end walls.

5. The radiating assembly means of claim 2, further comprising opposed end walls, and wherein said radiating means is supported by said end walls.

6. The radiating assembly means of claim 1, wherein said channel bottoms are substantially U-shaped.

7. The radiating assembly means of claim 2, wherein said channel bottoms are substantially U-shaped.

8. The radiating assembly means of claim 1, wherein said radiating means comprises at least one infrared lamp.

9. The radiating assembly means of claim 2, wherein said radiating means comprises at least one infrared lamp.

10. A heating unit for heating a substrate comprising a plurality of modules, a plurality of lamp assemblies supported in substantially parallel relation in said modules for selectively radiating said substrate, convention means associated with said modules for creating convection currents in said modules, and a plurality of reflectors in said modules, each positioned about a lamp assembly, each reflector comprising an elongated substantially planar top reflector member having elongated opposed reflector arms extending downwardly therefrom at an increasing angle with respect to each other, each elongated opposed reflector arm being connected to an elongated out side wall by a channel bottom, each said channel bottom having a plurality of holes along its length which permit the passage of said convection currents therethrough and direct the same towards said substrate for impingement thereon; each reflector confining the light emitted from each lamp assembly to a narrow path so as to substantially eliminate light from each lamp assembly from interfering with light emitted from the remaining lamp assemblies, said reflectors being positioned in said modules to receive said convection currents which flow through said plurality of holes so as to cool the reflectors and heat the substrate.

11. A heating unit in accordance with claim 10, wherein the plurality of modules are positioned above and below the substrate.

12. A heating unit in accordance with claim 10, wherein said lamp assemblies are aligned in the longitudinal direction of the substrate.

13. A heating unit according to claim 10, wherein said lamp assemblies comprise infrared lamps.

* * * * *